United States Patent [19]

Desmur

[11] Patent Number: 5,045,749

[45] Date of Patent: Sep. 3, 1991

[54] ELECTRON BEAM GENERATOR AND ELECTRONIC DEVICES USING SUCH A GENERATOR

[75] Inventor: Henri Desmur, Sevres, France

[73] Assignee: Thomson Tubes Electroniques, Boulogne Billancourt, France

[21] Appl. No.: 486,749

[22] Filed: Mar. 1, 1990

[30] Foreign Application Priority Data

Mar. 7, 1989 [FR] France ..... 89 02966

[51] Int. Cl.[5] ..... H01J 1/20; H01J 1/46

[52] U.S. Cl. ..... 313/305; 313/338

[58] Field of Search ..... 313/305, 338, 337

[56] References Cited

U.S. PATENT DOCUMENTS

| | | | |
|---|---|---|---|
| 1,864,591 | 6/1932 | Foster | 313/305 X |
| 2,284,389 | 5/1942 | Hansen | 313/305 X |
| 2,408,709 | 10/1946 | van den Bosch . | |
| 2,467,840 | 4/1949 | Mallinckrodt | 313/305 X |
| 2,485,668 | 10/1949 | Smyth | 313/337 X |
| 2,567,624 | 9/1951 | Thomson et al. | 313/337 X |
| 2,684,453 | 7/1954 | Hansell | 313/305 X |
| 2,888,591 | 5/1959 | Schmidt et al. | 313/337 X |
| 2,953,701 | 9/1960 | Gale | 313/305 X |
| 3,185,882 | 5/1965 | Dryden et al. | 313/305 X |
| 3,453,480 | 7/1969 | Katz | 313/338 X |
| 3,474,282 | 10/1969 | Katz et al. | 313/338 X |
| 3,980,920 | 9/1976 | Dudley . | |
| 4,115,720 | 9/1978 | Levine | 313/337 |
| 4,401,919 | 8/1983 | Weiss | 313/337 X |

FOREIGN PATENT DOCUMENTS

| | | | |
|---|---|---|---|
| 764127 | 5/1954 | Fed. Rep. of Germany . | |
| 1439260 | 5/1969 | Fed. Rep. of Germany . | |
| 1527924 | 6/1968 | France . | |
| 109632 | 4/1989 | Japan | 313/305 |
| 643655 | 9/1950 | United Kingdom | 313/338 |

*Primary Examiner*—Palmer C. DeMeo

*Attorney, Agent, or Firm*—Oblon, Spivak, McClelland, Maier & Neustadt

[57] ABSTRACT

An electron beam generator which can operate in pulse or continuous mode, has an electron beam which is emitted in a main electron gun including a thermionic cathode and an anode. Used in association with this main electron gun is an auxiliary electron gun including a cathode, a grid intended to modulate an auxiliary electron beam in pulses when it is operating in pulse mode or to adjust the current of the auxiliary electron beam when it is operating in continuous mode, and an anode. The anode is in thermal and electric contact with the cathode of the main electron gun. The auxiliary electron beam controls the emission from the cathode. The electron beam emitted by the main electron gun is not disturbed by crossing the grid. Application of the electron beam generator is notably to microwave longitudinal interaction tubes operating at high average and/or peak power.

13 Claims, 5 Drawing Sheets

ELECTRON BEAM GENERATOR AND ELECTRONIC DEVICES USING SUCH A GENERATOR

BACKGROUND OF THE INVENTION

1. Field of the invention The present invention relates to electron beam generators used in microwave tubes and particle accelerators and more particularly to an electron beam generator able to operate in either a pulse or a continuous mode such that when operating in pulse mode the electrons coming from a cathode are produced only during very short periods of time and the electron beam is broken up.

The invention applies more particularly to microwave tubes with longitudinal interaction, such as progressive wave tubes or klystrons.

2. Description of the Prior Art

An electron beam is generated by an electron gun which is often built around an axis of revolution. An electron gun comprises mainly a thermionic cathode, heated by a filament and connected to high negative voltage. The cathode emits a beam of electrons towards an anode with an aperture in its center to let the electron beam pass through.

Having gone through the anode, the electron beam enters an application device, in the form of a tunnel, which can be the body of a microwave tube. This device is generally earthed or grounded and finishes with a collector. The anode can be set to the same potential as the application device or an intermediate potential between that of the cathode and that of the application device.

Focussing electrodes and grids can be inserted between the cathode and the anode. All the electrodes going from the cathode to the anode constitute the electron gun.

At present, there exist two main methods of obtaining a pulsed electron beam.

The first consists in modulating all or none of the high voltage supply to the cathode.

The second method consists in introducing a modulation grid between the cathode and the anode. This grid is supplied by a relatively low voltage in pulse mode.

Unfortunately, both of these methods have disadvantages.

In the first method a power modulator is introduced between the high voltage source and the cathode. This power modulator produces a square pulse signal. But the rise and fall time of the signal is long, due to the internal impedance of the high voltage source and the high reactances of the electron gun. In addition, a considerable loss of energy appears due to the energy stored in the parasitic reactances of the supply circuit and the gun. Finally, the electrons produced by the cathode have a variable velocity during the rise and fall of the signal, making it difficult to focus the electron beam.

The second method does not involve the same disadvantages, as the high voltage applied to the cathode remains constant.

In this method a modulation grid is placed between the cathode and the anode.

This modulation grid is supplied with pulses by a voltage close to the high voltage supplying the cathode. Very often, a second grid is inserted between the cathode and the modulation grid, these two grids being approximately parallel and their apertures placed opposite each other. The second grid is set to the same potential as the cathode; it is very close to the cathode and can even rest on it. The electron beam obtained after crossing the grids is made up of many elementary beams. If the operation has high average power, it is necessary to use reduced interception grids, so as to limit overheating.

The electron beam generators operating in continuous mode also generally possess at least one grid placed between the cathode and the anode. This grid is supplied by a control voltage which then enables the current of the electron beam to be adjusted.

However, these grids have structures which introduce aberrations in the elementary beams and these converge badly as a whole. These guns with modulation or control grids do not give satisfactory transmission of the electron beam along the application device. A large part of the power cannot be recovered by the application device, and it is dissipated in a useless and even harmful manner in this device.

SUMMARY OF THE INVENTION

The object of the present invention is to overcome these disadvantages by proposing an electron beam generator which can operate in pulse or continuous mode, at constant high voltage and at low modulation or control voltage. With this electron beam generator, a transmission ratio of the beam is obtained between the entrance and exit points of the application device which is greater than that of the tubes comprising a grid gun in the normal technique. The beam generator thus constructed is particularly compact and it avoids the use of a high voltage power modulator.

To attain this object, the present invention proposes an electron beam generator comprising a main electron gun with a thermionic cathode emitting the electron beam towards an anode, wherein, with a view to enabling control of the electron beam without using a grid in front of the thermionic cathode, an auxiliary electron gun is placed behind the thermionic cathode, including an emitting auxiliary cathode, an auxiliary anode in thermal and electrical contact with the thermionic cathode, and a control grid between the auxiliary cathode and the auxiliary anode, the auxiliary electron gun emitting an auxiliary electron beam which can be modulated by the control grid, this auxiliary electron beam controlling the emission of the electron beam emitted by the thermionic cathode.

Thus, two electron guns assembled in series are used, namely an auxiliary gun of the grid type placed before or upstream from a main gun without a grid. The electron beam from the main gun is controlled by the electron beam from the auxiliary gun. The electron beam from the auxiliary gun serves to control the voltage of the cathode of the main gun. In addition, it can even serve to heat the cathode of the main gun. The electron beam from the main gun does not cross a grid, is not disturbed and converges correctly. The disturbances of the electron beam in the auxiliary gun are not found in the electron beam produced in the main gun.

According to a first embodiment, the auxiliary gun is of the type of gun with at least one grid, for a longitudinal interaction tube operating in pulse or continuous mode. The main gun is of the type with no grid, for a longitudinal interaction tube operating in continuous mode. The anode of the auxiliary gun is solid and is bombarded by the electron beam from the cathode of the auxiliary gun.

A magnetic or electromagnetic focussing device can be arranged around the auxiliary gun.

According to another embodiment, the auxiliary gun is of the type of gun used with a conventional coaxial structure tube with a cylindrical concentric cathode and anode. In both embodiments, the same main gun is used.

According to a feature of the invention, the distance covered by the electron beam from the auxiliary gun is much less than that covered by the electron beam from the main gun. The current density of the electron beam from the auxiliary gun is weak in comparison with the current density of the electron beam from the main gun.

The electron beam generator can be surrounded by a sealed vacuum chamber, divided into two compartments by an airtight partition, one gun being located in each compartment.

Each of the guns can be placed in a sealed elementary vacuum chamber, the chambers having a common wall, at least in part.

The electron beam generator can be used for longitudinal interaction tubes, operating in pulse or continuous mode, of the progressive wave tube or klystron type, and even for particle accelerators. It applies particularly to tubes operating at high average and/or peak power.

BRIEF DESCRIPTION OF THE DRAWINGS

Other characteristics and advantages of the invention will appear on reading the description below, given as a non-restrictive example and illustrated by the appended figures.

On these figures the same reference numbers designate the same parts. The proportions are not respected, for the sake of clarity.

DESCRIPTION OF THE PREFERRED EMBODIMENTS

Figure 1:
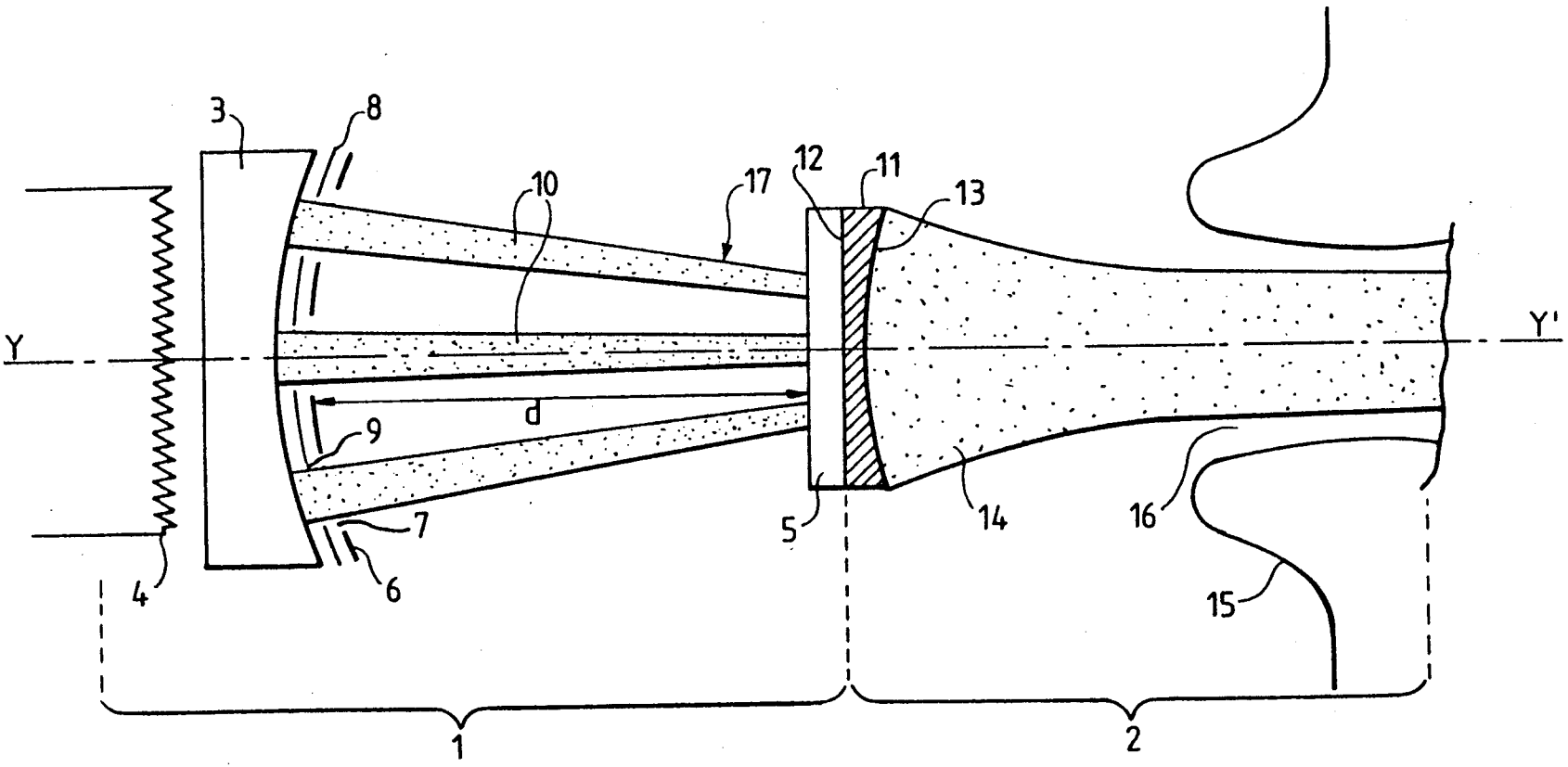
FIG. 1 represents a schematic section of a first embodiment of an electron beam generator according to the invention.

The electron beam generator represented in FIG. 1 comprises an auxiliary electron gun 1 constructed around an axis of rotation YY', mounted in series with a main electron gun 2 constructed around an axis of revolution situated coincident with the axis YY'. The main electron gun 2 is located downstream from or after the auxiliary electron gun 1.

The auxiliary electron gun 1 includes a cathode 3 having for example, a heat-emitting material, set to a constant high negative voltage. An oxide cathode can be used.

The cathode is heated by a filament 4. In operation, an electron beam, generally indicated at 17, with a longitudinal axis coincident with axis YY', is emitted in the direction of an anode 5. This anode 5 is bombarded by the electrons of the beam 17, the anode preferably being in the form of a full disk and is approximately normal to the axis YY-. It can be made of molybdenum, for example.

The auxiliary electron gun 1 represented here operates in pulse mode. The electron beam generator according to the invention also operates in pulse mode. But this is not necessary and the invention can also apply to an electron beam generator operating in continuous mode.

The auxiliary electron gun 1 includes a modulation grid 6, inserted between the cathode 3 and the anode 5. This modulation grid 6 has apertures 7 which channel the electrons emitted by the cathode 3. After passing this grid 6, there are several elementary electron beams 10 which converge in the direction of the anode 5 and contribute to the formation of the auxiliary electron beam 17 which bombards the anode 5. As the proportions of the different parts of the figure have not been respected, the elementary beams are out of proportion. This modulation grid 6 is supplied with a pulsed voltage, the difference in potential between the grid 6 and the cathode 3 being slight.

FIG. 1 shows another grid 8 placed between the modulation grid 6 and the cathode 3, which is at the same potential as the cathode 3. The grid 8 could even rest directly on the cathode 3. The grid 8 has apertures 9 which are aligned with the apertures 7 in the modulation grid 6. The apertures 7 in the modulation grid 6 are however wider than the apertures 9 in the grid 8. The grid 8 serves as a mask to prevent the electrons leaving the cathode 3 opposite the solid parts of the grid 8 from bombarding the grid 6.

The grids 6, 8 and their apertures 7, 9 are arranged in such a way that the elementary beams 10 converge as well as possible towards the anode 5. If necessary, a magnetic or electromagnetic device can be added around the auxiliary electron gun 1. This focussing device is represented with the reference 65 in FIG. 5. This focussing device 65 is usually unnecessary in practice, since the interval d between the modulation grid 6 and the anode 5 is small and the distance covered by the electrons from the cathode 3 is short.

The main electron gun 2 is mounted in series with the auxiliary electron gun 1 and is placed after or downstream from the auxiliary electron gun 1. This main electron gun 2 belongs to the type of gun for longitudinal interaction tubes.

The main electron gun 2 is equipped with a cathode 11 which is in electric and thermal contact with anode 5 of the auxiliary electron gun 1.

During operation, this cathode 11 emits a main electron beam 14 towards anode 15 which has a centrally-located aperture 16. The main electron beam 14 passes through the anode 15 and may then enter an application device, which is not represented here. This application device may consist of the body of a hyperfrequency longitudinal interaction tube.

The cathode 11 has basically the form of a disk, one of the main sides 12 of which is fixed by means of brazing or equivalent techniques, to the anode 5 of the auxiliary electron gun 1. The other side of the disk 13, turned downstream from the main electron gun 2, is slightly concave in order to produce a main electron beam 14 which is convergent. The cathode 11 may be impregnated, for example sintered tungsten impregnated with barium and calcium may be used.

The structure of an electron beam generator functioning continuously is largely similar.

The only difference is in the power supply for the grid 6 inserted between the cathode 3 and the anode 5. This grid 6 will in fact be a control grid used to adjust the current of the auxiliary electron beam 1, with the power coming from the control voltage and with only a very small difference between the potentials of the grid 6 and the cathode 3.

The operation, the electron beam generator will be described hereinafter with reference to FIGS. 3 and 4.

Figure 2:
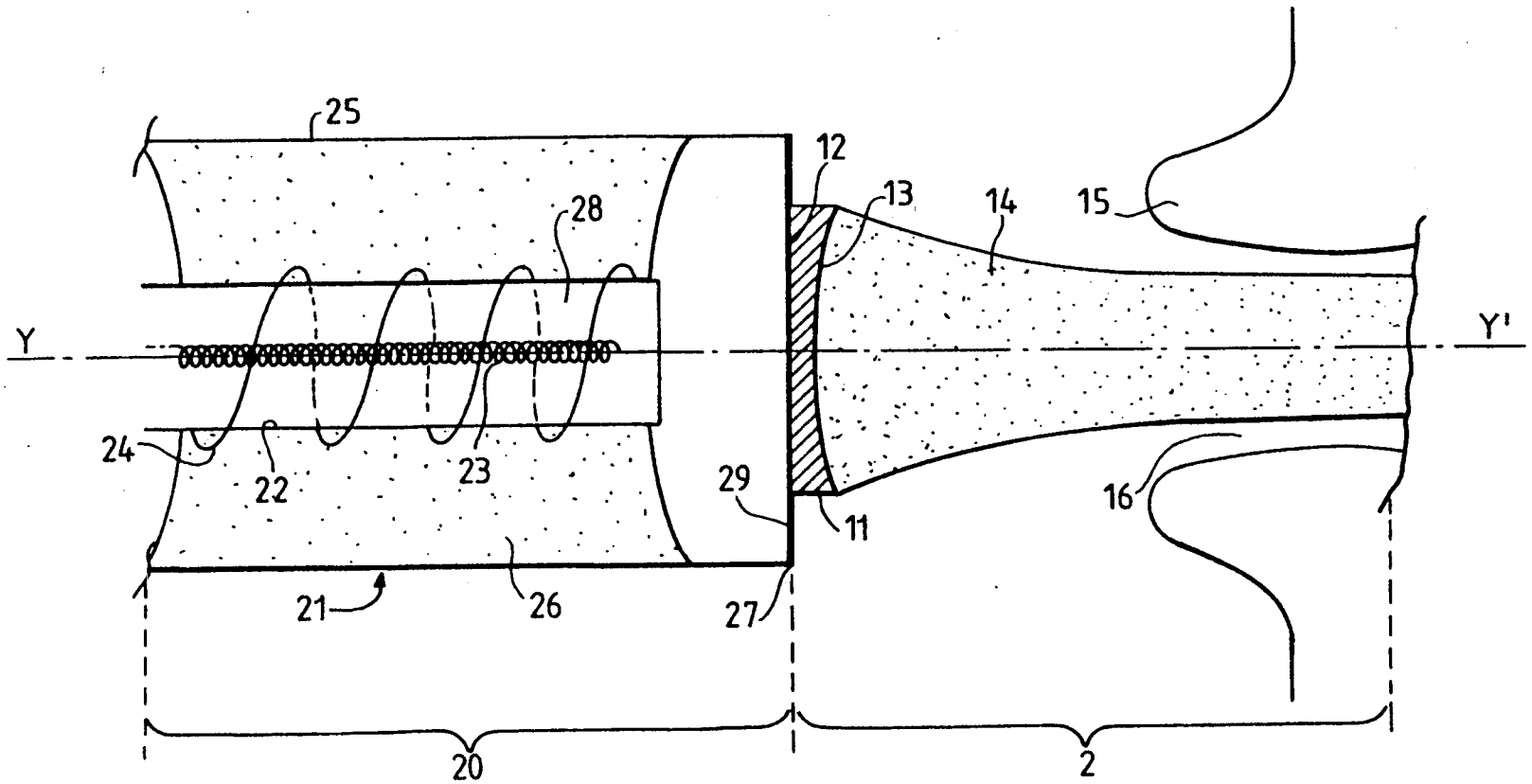
FIG. 2 represents a schematic section of another embodiment of an electron beam generator according to the invention.

FIG. 2 represents an alternative version of the electron beam generator from that described in the FIG. 1, equipped with a main electron gun 2 and an auxiliary electron gun 20. This electron beam generator can operate in pulse or continuous mode. The differences between the generators described in FIG. 1 and FIG. 2 only concern the auxiliary electron gun 20. The main electron gun 2 is identical to that in FIG. 1 as regards its location and its structure.

The auxiliary electron gun 20 here is a gun used for a conventional triode tube with a coaxial structure. This electron gun 20 is always built around the axis of rotation YY'. It is equipped with a hollow, cylindrical cathode 22 which is centered on the axis YY' and is heated by a filament 23. A filament 23 is placed inside the cathode 2 along the axis YY'. The cathode 22 is set to a high constant voltage. The cathode 22 is surrounded by a grid 24, which is surrounded in turn by an anode 25. A second grid may be used as in FIG. 1. Grid 24 has a number of apertures 28 in it.

Both the grid 24 and the anode 25 have a hollow, cylindrical form and are coaxial to the cathode 22. The grid 24 receives a pulse modulation voltage when the electron beam generator operates in pulse mode, and a control voltage when the electron beam generator operates in continuous mode, there being only a small difference in the potentials of the grid 24 and the anode 25.

The anode 25 is in electric and thermal contact with the cathode 11 from the main electron gun 2. To make this contact possible, the anode 25 has an extremity 27 which is closed off by a wall 29 normal to the axis YY'. The cathode 11 shall be fixed to this wall 29 by brazing or an equivalent technique.

In operation, the outer surface of the cathode 22 emits an electron beam 26 in which the electrons move in radial directions from the axis YY'.

These electrons go through the grid 24 via apertures 28 and are captured by the anode 25.

Due to the short distance between the cathode 22 and the anode 25, it is not necessary to introduce a focussing device. However, a magnetic or electromagnetic focussing device may be placed in the conventional manner, around the main electron gun 2.

Figure 3:
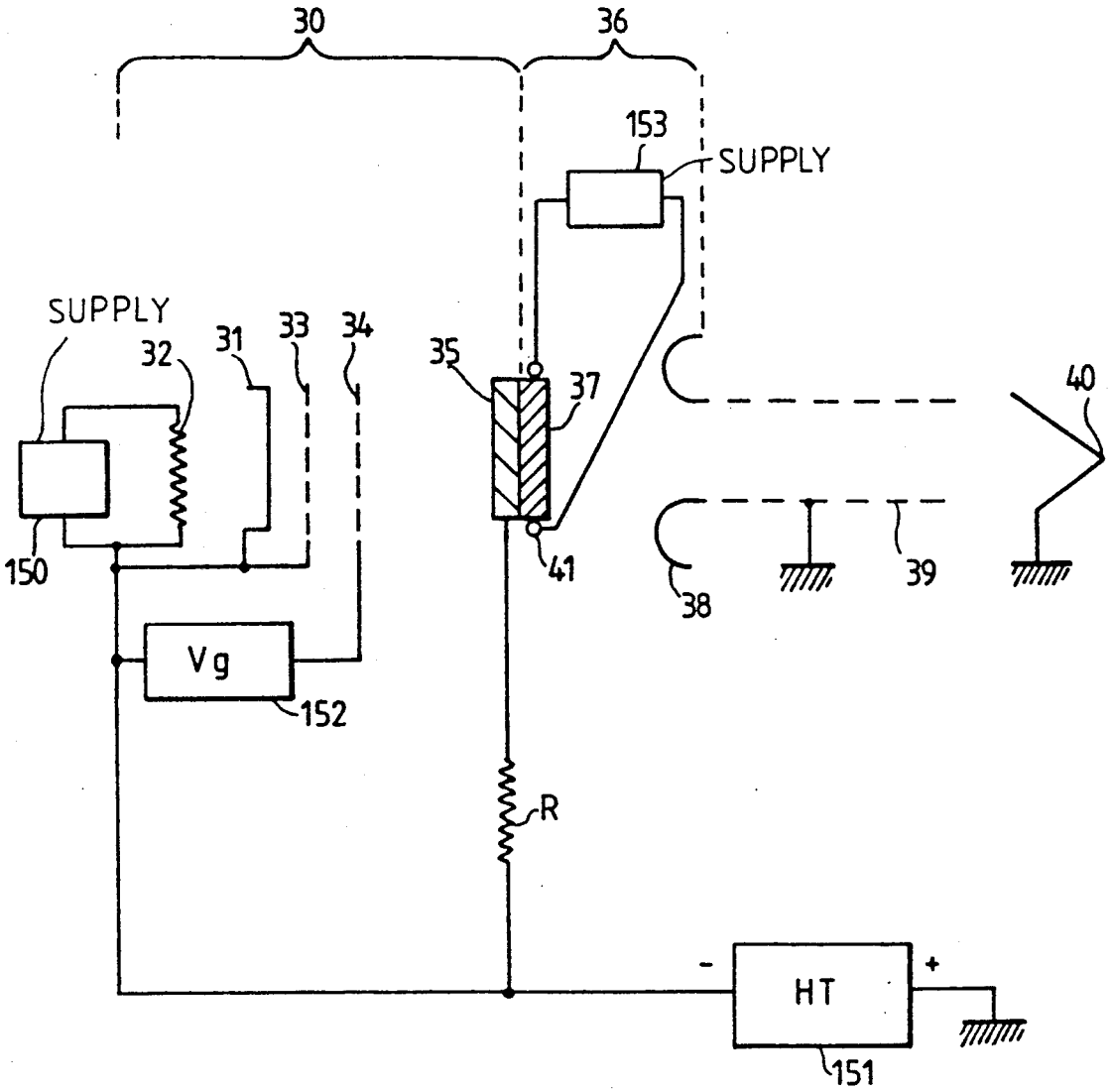
FIG. 3 represents an electrical wiring diagram of an electron beam generator according to the invention.
Figure 4:
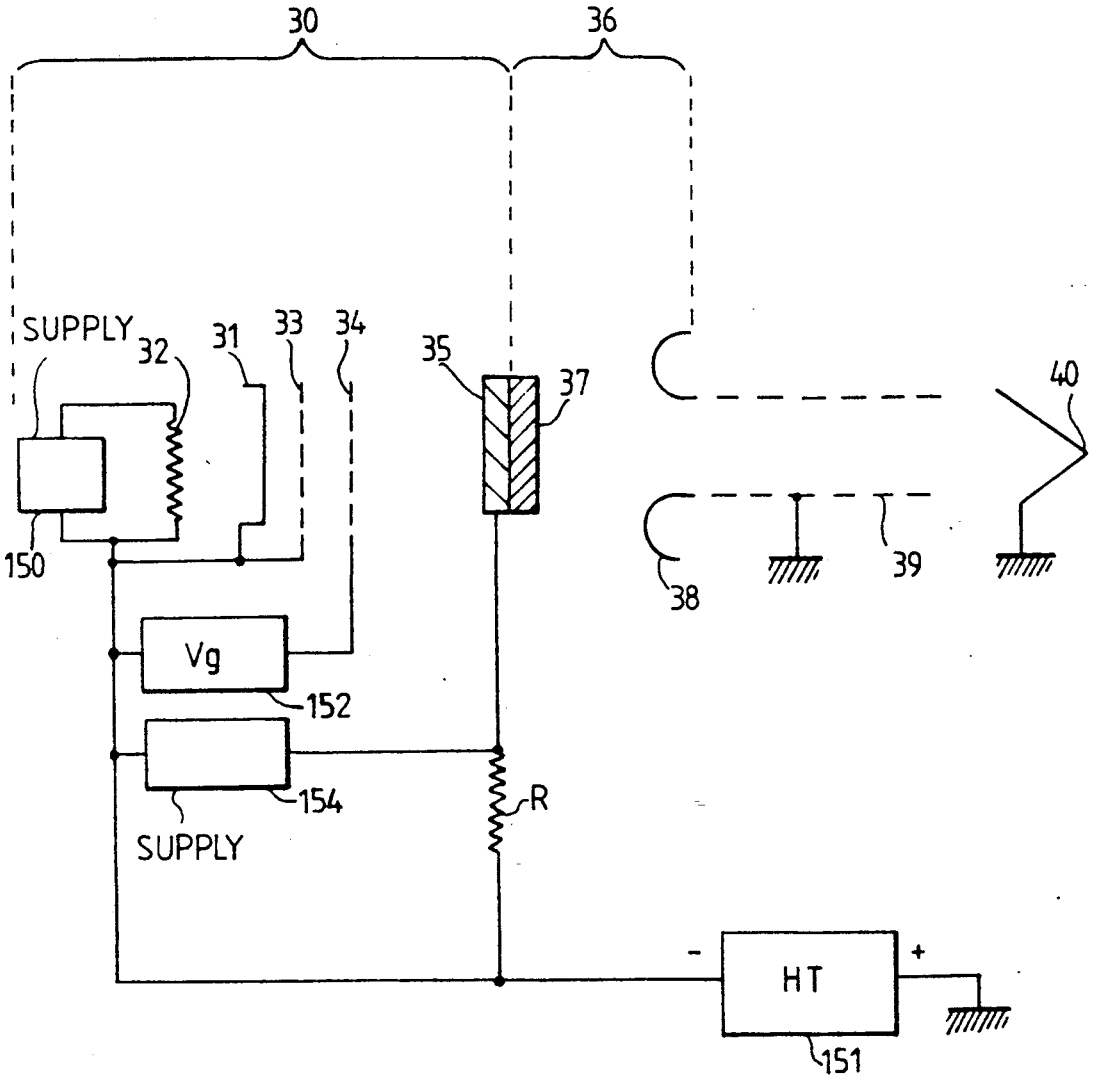
FIG. 4 represents a variant of the preceding wiring diagram.

FIG. 3 represents an electrical wiring diagram for an electron beam generator according to the invention operating in the pulse mode.

The auxiliary electron gun is under reference number 30 and is equipped with a cathode 31, a heating filament 32, a grid 33 connected to a cathode 31, a modulation grid 34 and an anode 35. The main electron gun is under reference number 36 and is equipped with a cathode 37 in thermal and electric contact with the anode 35, a filament 41 heating cathode 37 and an anode 38. The cathode 37 emits a main electron beam which after having passed through the anode 38 enters the application device 39, which, in this case is tunnel-shaped. The application device 39 and the anode 38 are earthed. On leaving the tunnel the main electron beam is capted by collector 40 which is also earthed.

The filament 32 is conected to a power supply 150 which provides a permanent heating voltage.

The cathode 31 and grid 33 are connected to the power supply 151 which provides a high negative voltage varying between a few kilovolts and several hundred kilovolts with respect to the earth. A high-power resistor R is connected between the anode 35 and the negative terminal of the power supply 151.

The modulation grid 34 is connected to a power supply 152 which provides a pulse modulated voltage. The difference in potential Vg between grid 33 and cathode 31 is very small. It can vary between 500 volts and 1000 volts in absolute terms.

When the difference in potential Vg between the grid 34 and the cathode 31 is negative, the auxiliary electron gun is in a blocked state. The grid 34 repels the electrons emitted by cathode 31. The anode 35 of the auxiliary electron gun 30 is set to a potential close to that of the cathode 31, due to the fact that there is an absence of current in the auxiliary electron gun 30.

The cathode 37 of the main electron gun 36 has a weak potential with respect to earth, due to the drop in voltage across the high-power resistor R under the influence of a thermionic current induced by the power supply 151. The main electron gun is in actual fact blocked.

When the potential difference Vg between the grid 34 and the cathode 31 is positive, the auxiliary electron gun becomes unblocked. The cathode 31 heated by the filament 32 emits an auxiliary electron beam which is no longer repelled by the grid 34. This auxiliary electron beam bombards the anode 35. The anode 35 then has a potential almost equivalent to that of the cathode 31, in other words, 1 high negative voltage less the internal voltage drop of the auxiliary electron gun 30.

The heating filament 41 of the cathode 37 is connected to a power supply 153 which provides a heating voltage. The cathode 37, when heated and almost at the same potential as the anode 35, emits a main electron beam towards the anode 38, this beam then enters the application device 39.

The voltage provided by the power supply 152 is pulse modulated, therefore the auxiliary electron gun 30 switches from a blocked state to an unblocked state. These two states follow each other very rapidly, the main electron beam is modulated in pulses.

During operation, the heating filament 41 may be disconnected, the cathode 37 continuing to be heated by the anode 35 bombarded by the auxiliary electron beam. The filament 41 is only used at the start-up of the electron beam generator, and it increases parasitic capacity. As it is only used for start-up, it is possible to envisage filament 41 being removed and replaced by an auxiliary power supply 154, placed in parallel with the resistor R as shown in FIG. 4. The power supply 154 may be disconnected as soon as the auxiliary electron gun starts bombarding the anode 35. Obviously, during the heating period, the potential of the grid 34 with respect to the cathode 31 must be positive in order to allow the current to circulate in the auxiliary electron gun 30.

When the electron beam generator operates in continuous mode, the wiring diagram is similar taking into account the different power supply for the grid of the auxiliary gun which is for adjusting the current of the auxiliary electron beam. This grid instead of receiving a pulse voltage receives a control voltage which can be adjusted.

Figure 5:
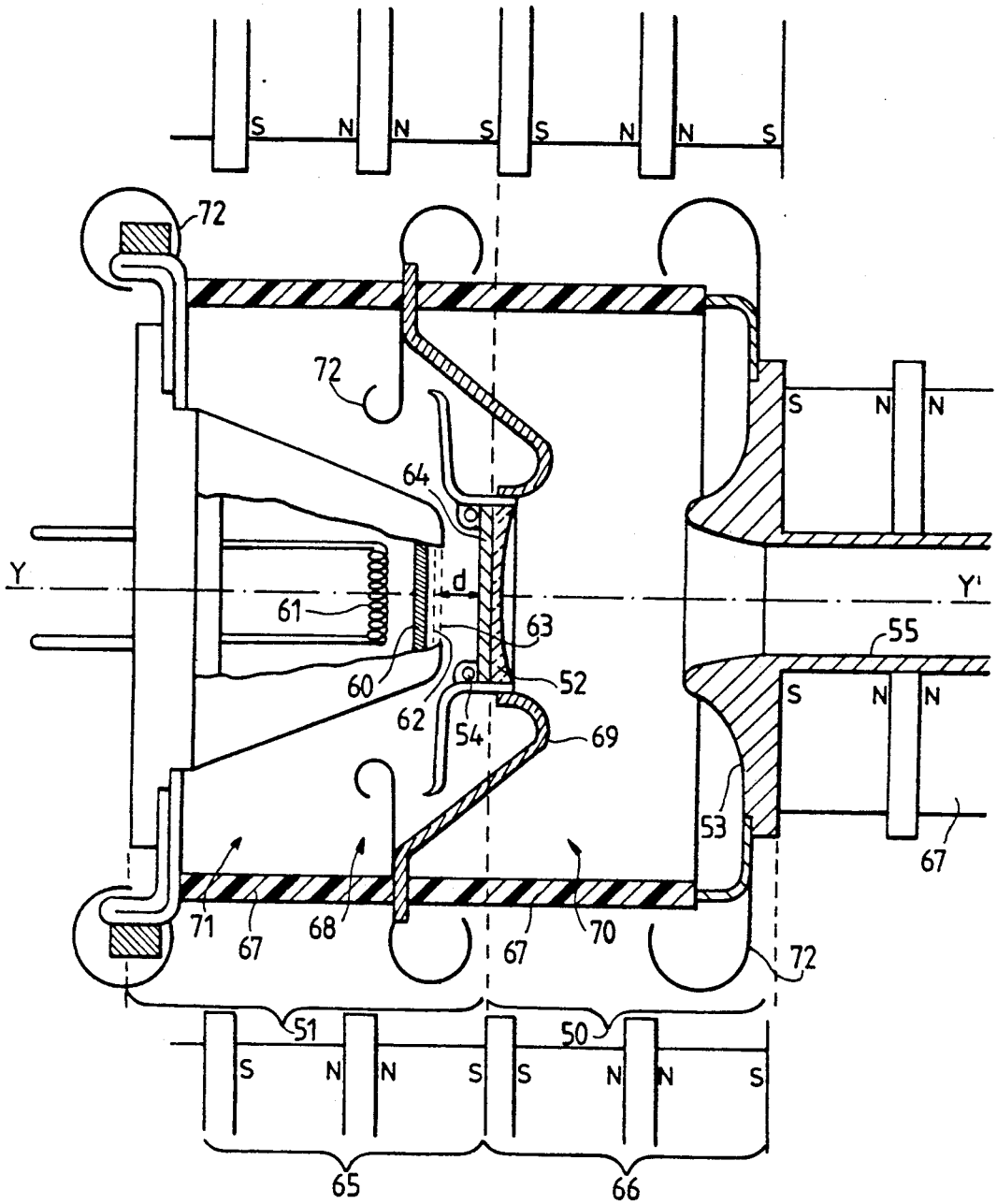
FIG. 5 represents in section an electron beam generator comparable to that in FIG. 1.

FIG. 5 represents, in section, an electron beam generator operating in pulse or continuous mode according to the invention. This generator may be compared to the one described in FIG. 1. It is built around an longitudinal axis of rotation YY'. It is equipped with a main electron gun 50 mounted in series with an auxiliary electron gun 51.

The main electron gun 50 is of the type of gun used with longitudinal interaction tubes which operate in pulse or continuous mode. It comprises a cathode 52, an anode 53 and a filament 54 for heating the cathode 52. The anode 53 is fixed to an application device 55 in the form of a tunnel.

The auxiliary electron gun 51 is of the type of gun with a grid for a longitudinal interaction tube operating in pulse or continuous mode. It is equipped with a cathode 60 heated by a filament 61, two grids 62,63 (the grid 62 is inserted between the grid 63 and the cathode 60) and a solid anode 64. The grid 62 is at the same potential as the cathode 60 and acts as a mask. The grid 63 is a modulation or control grid. The cathode 52 is in thermal and electric contact with the anode 64.

A number of focussing devices 65,66,67 have been represented using a sequence of alternating magnets.

The first focussing device 65 surrounds the auxiliary electron gun 51. The second focussing device 66 surrounds the main electron gun 50. The third focussing device 67 surrounds the application device 55. They contribute to the correct converging of the electron beams emitted by the cathode 60 and the cathode 52. It would be possible to remove the focussing device 65 which surrounds the auxiliary electron gun, as the distance covered by the electron beam in the interval d between the cathode 60 and the anode 64 is short.

Insulating spacers 67, made of ceramic for example, and cylindrical in shape, provide a support for the electrodes and electrically insulate them from one another. These spacers 67 contribute to forming a sealed chamber 68 to surround all the electrodes. A vacuum is created in this chamber 68. Preferably, a sealing partition 69 should divide the inside of the chamber 68 into two distinct sealed parts 70,71. The compartment 70 surrounds the main electron gun 50 and the compartment 71 surrounds the auxiliary electron gun 51.

Separating the chamber 68 into two compartments 70,71 makes it possible for the two atmospheres surrounding the electron guns to be totally independent. It is always possible for untimely degassing of metal parts of the electron gun to occur during operation, even if there is a vacuum in the sealed chamber 68.

In the FIG. 5, the partition 69 consists of a metal sheet, and, therefore, can also supply the electrical power for the anode 64.

It would have been possible to place each electron gun 50,51 in a separate chamber, with there being a common partition or wall between the two.

The metal parts 72, made of nickel or copper, for example, are to avoid a breakdown due to electrical discharge. These parts are connected to the electrode or to a part of one of the guns which is at a high potential in absolute terms. They channel the electric fields towards the insulating spacers 67 and/or out of the chamber 68. These parts 72 have at least one of their ends in the form of a loop. The loops extend either towards the exterior of the chamber 68, or towards the interior.

An electron beam from a cathode has a natural tendency to diverge, owing notably to the effects of mutual repulsion of the electrons.

The electrons from the cathode 60 cover a short distanced before reaching the anode 64. The electrons from the cathode 52 cover a long distance, and after crossing the anode 53 they penetrate into the application device 55.

The shorter the distance covered, the less the electron beam tends to diverge, and a beam can be produced whose current density is low. On the other hand, the longer the distance covered by the electron beam, the higher the current density of the beam must be. The lifetime of a cathode varies inversely with the current density of the electron beam produced. When the electron beam generator according to the invention is operating, approximately the same current passes through the two cathodes 60 and 52. A cathode 60 can be selected with a larger surface area than the cathode 52, thus the electron beam from the cathode 60 will have a current density lower than that of the electron beam from the cathode 52.

A compromise will be made when the dimensions of the two cathodes 52,60 are chosen, as the whole of the auxiliary electron beam from the cathode 60 must act on the cathode 52. In addition, the lifetime of the cathode 52 must be reasonable. In FIG. 5, the proportions have not been respected.

This construction enables a particularly compact electron beam generator operating in pulse or continuous mode to be obtained. In comparison with conventional constructions, this embodiment enables reduction of the parasitic capacity of the cathode 52 with respect to the earth, reduction of the energy used for pulse modulation, and optimisation of the rise and fall time of the pulses.

The main electron beam is not disturbed when crossing the grids. The transmission ratio of the main electron beam between the entrance and exit points of the application device is close to that obtained with a gun without a grid, operating in continuous mode, i.e. of the order of 99 %. With this construction, all the advantages of pulse modulation or control of the electron beam are retained, without the disadvantages caused by grids.

Such an electron beam generator has an application in longitudinal interaction tubes such as progressive wave tubes or klystrons. More particularly, it can be used in tubes with high peak and/or average power, due to the high transmission ratio of the electron beam between the entrance and exit points of the application device.

This electron beam generator can also be used in particle accelerators.

The present invention is not restricted to the examples described, notably as regards the geometry of the parts constituting the two electron guns.

What is claimed:

1. An adjustable electron beam generator operating in one of a pulse and continuous mode, comprising:

a main electron gun including a thermionic cathode for emitting an adjustable electron beam towards an apertured anode thereof, the main electron gun being free from a grid and the adjustable electron beam being controlled without using a grid in front of the thermionic cathode, and an auxiliary electron gun located behind the thermionic cathode including an emitting auxiliary cathode, an auxiliary solid anode in thermal and electric contact with the thermionic cathode, and a control grid between the auxiliary cathode and the auxiliary anode, the auxiliary cathode emitting an auxiliary electron beam towards the auxiliary anode modulated by the control grid, this auxiliary electron beam controlling the emission of the adjustable electron beam emitted by the thermionic cathode.

2. An electron beam generator according to claim 1, wherein the auxiliary anode of the auxiliary electron gun is in contact with a non-emitting face of the thermionic cathode of the main electron gun.

3. An electron beam generator according to any one of claims 1 and 2, wherein the beam generator is constructed around an axis of rotation YY', the auxiliary cathode, the grid and the auxiliary anode of the auxiliary electron gun are located in sequence along the axis YY' in such a way that the electrons from the auxiliary electron beam are directed approximately along the YY' axis.

4. An electron beam generator according to claim 1, wherein the auxiliary anode of the auxiliary electron gun is solid.

5. An electron beam generator according to claim 1, wherein the auxiliary electron gun is surrounded by one of a magnetic and electromagnetic focussing device.

6. An electron beam generator according to claim 1, wherein the auxiliary anode, the grid and the auxiliary cathode are hollow, cylindrical and concentric about an axis YY', the grid surrounding the auxiliary cathode and being surrounded in turn by the auxiliary anode so that the electrons of the auxiliary electron beam are emitted in, radial directions from the axis YY'.

7. An electron beam generator according to claim 1, wherein distance covered by the auxiliary electron beam in the auxiliary gun is shorter than a distance covered by the electron beam in the main gun.

8. An electron beam generator according to claim 1, wherein an emitting surface of the auxiliary cathode is greater than an emitting surface of the thermionic cathode, so that a current density of the auxiliary electron beam is less than a current density of the beam.

9. An electron beam generator according to claim 1, wherein the thermionic cathode is heated by a filament.

10. An electron beam generator according to claim 1 wherein each of the electron guns is placed in a sealed chamber.

11. An electron beam generator according to claim 1, wherein the electron beam generator is surrounded by a sealed chamber divided into two sealed compartments by a partition, each electron gun being placed in one of the compartments.

12. An electron beam generator according to claim 1, further including a longitudinal interaction tube which functions in one of a pulse and continuous mode.

13. An electron beam generator according to claim 1, further including a particle accelerator.

* * * * *